United States Patent [19]

Hayakawa et al.

[11] Patent Number: 4,691,759

[45] Date of Patent: Sep. 8, 1987

[54] BINDER FOR DRY SAND MOLD AND METHOD OF ITS USAGE

[75] Inventors: Masaru Hayakawa, Tokyo; Takeshi Yoshida, Zushi; Atsushi Kaiya, Kawasaki, all of Japan

[73] Assignee: Nippon Petrochemicals Co., Ltd., Tokyo, Japan

[21] Appl. No.: 888,010

[22] Filed: Jul. 22, 1986

[30] Foreign Application Priority Data

Jul. 24, 1985 [JP] Japan ..... 60-163711
Aug. 9, 1985 [JP] Japan ..... 60-175246
Aug. 9, 1985 [JP] Japan ..... 60-175247

[51] Int. Cl.[4] ..... B22C 1/22

[52] U.S. Cl. ..... 164/526; 164/525; 523/139; 524/549

[58] Field of Search ..... 164/525, 526, 527, 12, 164/16; 523/139

[56] References Cited

U.S. PATENT DOCUMENTS 3,005,245 10/1961 Howard ..... 164/525 X

*Primary Examiner*—Koang Y. Lin
*Attorney, Agent, or Firm*—Fisher, Christen & Sabol

[57] ABSTRACT

The present invention provides a binder for foundry sand which comprises a hydrolyzate of a butadiene/-maleic anhydride copolymer, a neutralized or a partially neutralized substance of the hydrolyzate, a modified substance prepared by modifying the hydrolyzate with a basic organic compound, or a mixture thereof.

4 Claims, No Drawings

BINDER FOR DRY SAND MOLD AND METHOD OF ITS USAGE

BACKGROUND OF THE INVENTION (1) Field of the Invention

The present invention relates to a binder on dry sand for castings, a sand composition of moldings containing the sand binder and a method for preparing a sand mold for castings. More specifically, the binder of the present invention comprises a hydrolyzate prepared by hydrolyzing a butadiene/maleic anhydride copolymer, its neutralized substance or its partially neutralized substance, a modified substance prepared by modifying the hydrolyzate with a basic organic compound, or the like, and the sand mold for castings is manufactured by mixing an aqueous solution of the aforesaid binder with foundry sand, molding the resultant mixture, heating, drying and thereby curing.

(2) Description of the Prior Art

Heretofore, the manufacture of the sand mold for iron, aluminum catstings or the like has been carried out by blending an organic or an inorganic binder with foundry sand such as a slilica sand, molding and curing. The various binders which can be employed in such a way have both merits and demerits.

For example, if the used sand mold in which the binder is a water glass is discarded anywhere, it will contaminate the soil in the vicinity of the discarded mold, because the water glass which has adhered to the surfaces of the sand grains is alkaline. For the purpose of avoiding the problem of such an environmental pollution, the development in the sand binder comprising a material other than the water glass has been desired. As one strategy in reply thereto, much attention is paid to an organic binder the raw material of which is a self-curing furan resin or phenolic resin. These kinds of organic binders are advantageous, because it can be removed by rubbing the sands with one another or burning them after used, and the foundry sand can be reused. However, the operation of the rubbing or the like is troublesome, and in the time of the burning, a bad odor will give off inconveniently. Additionally, with regard to the organic binder, the curing rate of the binder and the mechanical strength of the sand mold remarkably vary with many factors such as properties of the foundry sand, water content, temperature, humidity, a kind and a concentration of an acid used as a curing agent, and in consequence its treatment is difficult. Moreover, the polymerization of the binder material acceleratedly makes progress gradually during storage, and thus the binder material has the drawback that it must be consumed within one year from the point of time when it has been manufactured.

As another organic binder, there has been suggested a copolymer of an α-olefin such as isobutylene and maleic anhydride. Such a water soluble polymer in which maleic anhydride and the like are used is considered to be rosy because of overcoming the above mentioned drawbacks, easily reproducing the foundry sand, and readily mixing with each of various kinds of polymers. However, by the method in which the binder comprising the above mentioned copolymer is employed, the sand mold having sufficiently great strength cannot be obtained. In view of the requirement of the high-quality and accurate castings at present, such a self-curing organic binder as the furan resin is unavoidably utilized for the sake of the middle-sized and large-sized sand molds for castings having a high accuracy, though it is still desired that the above mentioned drawbacks are overcome.

SUMMARY OF THE INVENTION

An object of the present invention is to provide a novel improved binder for use in the manufacture of sand molds for castings and a novel method of using this binder by which the drawbacks of the conventional manufacturing method of the sand molds for castings are overcome. That is, the sand mold manufactured by the use of the binder according to the present invention has excellent dry strength and nevertheless retains the merits of the sand mold made from the binder of the formerly suggested maleic anhydride copolymer, and accordingly, by employing the aforesaid sand mold regarding the present invention, the high-quality and accurate castings can be manufactured.

The sand mold obtained by the present invention can be used to manufacture the castings having the great dry strength, high quality and high accuracy. In addition, even if an amount of the organic binder in terms of a solid content is small, the enough dry strength can be obtained, which fact is economical. Further, even when any additive such as magnesium oxide is not added, it is possible to acquire the practically sufficient strength. If a polyvinyl alcohol is added thereto, a synergistic effect will be obtained, whereby the sand mold can be prepared which has the improved dry strength and which is scarcely broken even by a high temperature of a molten metals which will be poured thereinto. That is, since the sand mold of the present invention has very large thermal strength (the strength of sand mold during casting), which fact permits manufacturing the high-quality and accurate castings.

The foundry sand in which the aqueous solution of the organic binder according to the present invention is mixedly contained is better in fluidity, as compared with the foundry sand regarding the conventional manufacturing method, and in consequence, the foundry sand regarding the present invetnion can be easily and sufficiently molded in a molding box. That is, if the foundry sand having the good fluidity regarding the present invention is employed, molding can also be accomplished by a shaping device in which squeezing, jolting, vacuum processing or the like is utilized. In this molding operation, any high pressure is not particularly required, so that even by the use of a model such as a wooden pattern having the low resistance to mechanical pressure, the complicate and accurate sand mold can be manufactured.

The hydrolyzate of the butadiene/maleic anhydride copolymer and its neutralized substance regarding the present invention can be used in the form of the aqueous solution having a high concentration, since their solubility in water is higher, as compared with the α-olefin/-maleic anhydride copolymer which has been heretofore suggested. Accordingly, an amount of water used in manufacturing the sand mold can be reduced, so that the drying time of the sand mold and its cost can be saved. Further, it is unnecessary to add any alkali or the like in order to facilitate the dissolution of the copolymer in water.

The hydrolyzate of the present invention and the modified substance prepared by modifying it with a basic organic compound can be used irrespective of a pH of their aqueous solutions, for example, even on the acidic side of pH advantageously. Furthermore, even when no carbon dioxide gas is employed, the sufficient strength can be obtained.

Since the remaining strength (after solidification of molten metals) of the sand mold manufactured by the present invention is moderate, the used sand mold (which has been used for casting molten metals) can easily be broken and the used sand can be reutilized.

According to the present invention, the problems of the environmental pollution by the used sand, for example, the contamination of the soil and the bad odor in the time of its combustion do not take place.

DESCRIPTION OF THE PREFERRED EMBODIMENTS

Now, the present invention will be described in detail.

As a binder used to manufacture a sand mold for castings in the present invention, there is a hydrolyzate itself of a butadiene/maleic anhydride copolymer, a neutralized or a partially neutralized substance of the hydrolyzate, a modified substance of the hydrolyzate with a basic organic compound, or a mixture thereof. The amount of the binder in terms of a solid content may be within the range of 0.1 to 5 parts by weight based on 100 parts by weight of foundry sand.

The butadiene/maleic anhydride copolymer used in the present invention has a maleic anhydride unit of about 50 mol %, and its manufacture is carried out by copolymerizing butadiene and maleic anhydride in accordance with a process such as a solution polymerization or a slurry polymerization by the use of a radical polymerization initiator such as benzoyl peroxide or azobisisobutyronitrile in a solvent of a polar solvent such as a ketone, for example, acetone, methyl ethyl ketone or cyclohexanone, or tetrahydrofuran, dioxane or dimethylformamide; a non-polar solvent such as benzene; or a mixture thereof. By removing the used solvent after the reaction, the desired copolymer can be obtained. A molecular weight of the butadiene/maleic anhydride copolymer regarding the present invention is generally within the range of 3,000 to 300,000 or so. When this copolymer is dissolved in water, the anhydrous group of the acid is cleaved to be converted into carboxyl groups, so that the hydrolyzate is prepared. In the case of the solution polymerization, if the removal of the reaction solvent is carried out by steam stripping, the aqueous solution of the hydrolyzate can be practically prepared simultaneously with the removal of the solvent conveniently. However, in order to obtain the desired aqueous solution, the copolymer prepared in the above manner may be isolated and may be dissolved in water again.

The present invention may use a polymer (modified substance) prepared by modifying at least portions of the carboxyl groups in the hydrolyzate with a basic organic compound. The preferable basic organic compounds just referred to are basic nitrogen-containing compounds such as amines and ammonia, and in particular, ammonia is preferred because of being inexpensive. The polymer modified with the basic organic compound is an organic salt in which at least portions of the carboxyl groups in the hydrolyzate are neutralized with the basic organic compound such as ammonia or an amine, or a polymer in which an imide bond is formed between the two adjacent carboxyl groups comprising the maleic acid unit and a nitrogen atom in the above nitrogen compound. The above mentioned organic salt can easily be prepared by adding the basic organic compound, e.g., the amine to the aqueous solution of the hydrolyzate, or blowing an ammonia gas thereinto. Further, when the thus prepared aqueous amine salt or ammonium salt solution is suitably heated, an aqueous polymer solution containing the above mentioned imide bond can be prepared.

In the case of the preparation of the organic salt or the like, its neutralization degree can be optionally selected, and any pH value is usable.

The hydrolyzate of the butadiene/maleic anhydride can be in the form of its neutralized substance or its partially neutralized substance. In other words, at the least partially neutralized substance of the hydrolyzate prepared in the above mentioned procedure may be used. This neutralization can be carried out by adding, to the aqueous hydrolyzate solution, a basic metallic compound such as an oxide or a hydroxide of an alkali metal or an alkaline earth metal, e.g., sodium hydroxide, potassium hydroxide, magnesium hydroxide or magnesium oxide; or an organic base such as a basic organic compound, e.g., an amine or ammonia. However, when the neutralizate is used, it preferably has the smallest possible neutralization degree in view of economy, the dry strength of the sand mold and the like, and therefore the partially neutralized substance is preferred.

When the neutralization is carried out by the above mentioned basic metallic compound, a pH of the used aqueous binder solution preferably is 6 or less. If the pH of this solution is more than 6, the sand mold cannot have the sufficient dry strength inconveniently. Usually, the aqueous solution of the neutralized or partially neutralized substance does not gel particularly at ordinary temperature, so that an ample pot life can be taken advantageously.

In the present invention, a polyvinyl alcohol can be added to the binder. Even when the polyvinyl alcohol is added, the gelation scarcely occurs. As the binder to which the polyvinyl alcohol should be added, the aforesaid hydrolyzate of the butadiene/maleic anhydride copolymer is desirable. In addition, the substance partially neutralized with the basic metallic compound is also eligible. The polyvinyl alcohol is added in an amount of 3 to 97% by weight, preferably 20 to 80% by weight based on the total weight of the copolymer binder regarding the present invention. The addition of the polyvinyl alcohol permits providing a synergistic effect by which the dry strength of the sand mold is heightened and by which the sand mold is scarcely broken by molten metals which will be poured, in other words, by which the sand mold having the extremely great thermal strength is manufactured. Further, the addition of the polyvinyl alcohol permits manufacturing the sand mold having the ample dry strength even in a small solid amount, and thus such an addition is considered to be economical. The polyvinyl alcohol used in the present invention can be prepared by a known manner, for example, by the saponification of a polyvinyl acetate, and in this case, usually, a saponification degree is 50 mol % or more, and an average polymerization degree is within the range of 100 to 2,000 or so.

Now, the present invention will be described in reference to examples which do not intend to restrict the scope of the present invention.

EXAMPLE (Preparation of Binder)

Butadiene was reacted with maleic anhydride in the presence of a radical polymerization initiator (azobisisobutyronitrile) in acetone in order to prepare an acetone solution of a butadiene/maleic anhydride copolymer. The molecular weight of the copolymer was about 30,000, and a content of the maleic anhydride unit in the copolymer was about 50 mol %.

Next, steam was blown into the above acetone solution to distill off the acetone and to simultaneously cleave the anhydrous groups of the acid in the copolymer, so that an aqueous hydrolyzate solution of the butadiene/maleic anhydride copolymer was prepared. According to an IR analysis and the like, it was confirmed that the anhydrous groups of the acid in the copolymer were all cleaved to be converted into carboxyl groups. Caustic soda was then added to this aqueous solution in order to partially neutralize the carboxyl groups, thereby obtaining an aqueous sodium salt solution of the hydrolyzate of the butadiene/maleic anhydride copolymer of which solution pH was 3.5.

EXAMPLE 1

(Test of Binder)

In the aqueous solution of the hydorlyzate of the copolymer prepared in the previous "Preparation of Binder", the concentration of a solid content was adjusted to 25% by weight, and the aqueous solution was then kneaded with silica sand in solid content ratios shown in the following table. These mixtures had extremely good fluidity.

Next, each mixture was rammed in a 50 mmϕ×50 mm mold for preparing a mold test piece, and charging and molding were carried out by hand. The mold was placed in a microwave oven (0.5 kw) without releasing the mixture therefrom and was heated and dried for 10 minutes therein. After the heating and drying processes, each test piece was taken out therefrom, and dry strength was then measured with a mold strength gauge to which a penetrometer is applied. The results are set forth in the following table.

| Experimental No. | 1 | 2 | 3 |
|---|---|---|---|
| Solid content (parts by weight) based on 100 parts by weight of silica sand | 0.5 | 1.0 | 2.0 |
| Dry strength (kg/cm$^2$) | 49 | 76 | 78 |

The silica sand mixture of Experimental No. 2 above mentioned was used to actually manufacture a sand mold for castings, and a molten iron was cast in the thus manufactured sand mold. After solidification, the sand mold was broken. Since the remaining strength of the sand mold was moderate in spite of the high dry strength, the breakage of the sand mold was extremely easy. Further, the used sand could be reused.

EXAMPLE 2

An ammonia gas was blown into an aqueous solution of the hydrolayzate of the butadiene/maleic anhydride copolymer formed in the aforesaid "Preparation of Binder" in order to prepare an aqueous hydrolyzate ammonium salt solution in which a concentration of the solid content was 25% by weight. This aqueous solution was kneaded with silica sand in the same procedure as in Example 1, and molding, heating and drying were carried out to prepare a mold test piece. In this case, a ratio of the solid content based on 100 parts by weight of silica sand was 0.8 part by weight. For the thus prepared test piece, dry strength was measured. The result was 65 kg/cm$^2$.

EXAMPLE 3

(Test of Binder)

In the aqueous sodium salt solution of the polymer hydrolyzate obtained in the above mentioned "Preparation of Binder", a concentration of the solid content was adjusted to 25% by weight, and the aqueous solution was then kneaded with silica sand in solid content ratios shown in the following table. These mixtures had fluidity.

Next, each mixture was rammed in a 50 mmϕ×50 mm mold for preparing a mold test piece, and charging and molding were then carried out. The mold was placed in a microwave oven (0.5 kw) without releasing the mixture therefrom and was heated and dried for 10 minutes therein. After the heating and drying processes, the test pieces were taken out therefrom, and dry strength was measured. The results are set forth in the following table.

| Experimental No. | 4 | 5 | 6 |
|---|---|---|---|
| Solid content (parts by weight) based on 100 parts by weight of silica sand | 0.5 | 1.0 | 2.0 |
| Dry strength (kg/cm$^2$) | 45 | 72 | 73 |

EXAMPLE 4

To the aqueous solution of a partially neutralized hydrolyzate of the butadiene/maleic anhydride polymer obtained in the aforesaid "Preparation of Binder" in the example, a polyvinyl alcohol (saponification degree=98 mol %, average polymerization degree=300) was added and dissolved in solid content weight ratios shown in the following table.

(Test of Binder)

A concentration of the solid content in the thus prepared aqueous solution was adjusted to 25% by weight, and was then kneaded with silica sand so that the aforesaid solid content might be 2.0 parts by weight based on 100 parts by weight of the silica sand. The resultant mixtures had fluidity.

Next, each mixture was rammed in a 50 mmϕ×50 mm mold for preparing a mold test piece, and charging and molding were carried out by hand. The mold was then placed in a microwave oven (0.5 kw)without releasing the mixture therefrom and was heated and dried for 10 minutes therein. After the heating and drying processes, the test pieces were taken out therefrom, and dry strength was measured. The results are set forth in the following table.

| Experimental No. | 7 | 8 | 9 |
|---|---|---|---|
| Weight ratio (A)/(B) of solid content | 25/75 | 50/50 | 75/25 |
| Dry strength (kg/cm$^2$) | 83 | 97 | 87 |

COMPARATIVE EXAMPLE

An isobutene/maleic anhydrous copolymer (molecular weight=about 40,000, content of maleic anhydride group=about 50 mol %) was dissolved in water containing magnesium hydroxide in an amount corresponding to 30% equivalent of the maleic acid group in the above copolymer, and concentration was adjusted in order to prepare an aqueous solution in which the solid content was 25% by weight.

Separately, an aqueous polyacrylic acid solution in which the concentration of a solid content was 25% by weight was prepared.

Next, the above mentioned two kinds of aqueous solutions were mixed with silica sand in a ratio of 1.0 part by weight of the solid content based on 100 parts by weight of the silica sand in the same procdure as in Example 1 in order to prepare test pieces. For the latter, dry strength was measured. The results were from 40 to 50 kg/cm$^2$.

What is claimed is:

1. A method for manufacturing a sand mold for castings which comprises the steps of mixing foundry sand with an aqueous solution of a binder selected from the group consisting of a hydrolyzate of a butadiene/maleic anhydride copolymer, a neutralized or a partially neutralized substance of said hydrolyzate, a modified substance prepared by modifying said hydrolyzate with a basic organic compound, or a mixture thereof so that the amount of the binder in terms of a solid content is within the range of 0.1 to 5 parts by weight based on 100 parts by weight of said foundry sand, and molding, heating, drying and thereby curing the resultant mixture.

2. The method according to claim 1 wherein said binder contains 3 to 97% by weight of a polyvinyl alcohol based on the total weight of said binder.

3. The method according to claim 2 wherein said hydrolyzate is neutralized or partially neutralized with a basic metallic compound or a basic organic compound.

4. The method according to claim 3 wherein said aqueous solution of said neutralized or a partially neutralized substance of said hydrolyzate with a basic metallic compound has a pH value of 6 or less.

* * * * *